US008622098B2

(12) United States Patent
Veenendaal et al.

(10) Patent No.: US 8,622,098 B2
(45) Date of Patent: Jan. 7, 2014

(54) CONTAINER FOR FLUIDS, INSERT AND METHOD OF FILLING A CONTAINER

(75) Inventors: Jan Veenendaal, Den Helder (NL); Jan Dirk Veenendaal, Den Helder (NL); Hubert Joseph Frans Hanssen, Amsterdam (NL)

(73) Assignee: Eurokeg B.V., Den Helder (NL)

( * ) Notice: Subject to any disclaimer, the term of this patent is extended or adjusted under 35 U.S.C. 154(b) by 956 days.

(21) Appl. No.: 12/306,083

(22) PCT Filed: May 30, 2007

(86) PCT No.: PCT/EP2007/055235

§ 371 (c)(1),
(2), (4) Date: Dec. 30, 2009

(87) PCT Pub. No.: WO2008/000574

PCT Pub. Date: Jan. 3, 2008

(65) Prior Publication Data

US 2010/0089488 A1 Apr. 15, 2010

(30) Foreign Application Priority Data

Jun. 28, 2006 (EP) ..... 06116211

(51) Int. Cl.
*B65D 90/34* (2006.01)
*B65D 25/18* (2006.01)
*B67C 3/32* (2006.01)

(52) U.S. Cl.
USPC ..... 141/3; 141/10; 141/18; 141/316; 220/495.03; 220/495.04; 220/495.05

(58) Field of Classification Search
USPC ..... 141/2, 3, 10, 18, 68, 114, 313–317; 220/495.01, 495.03–495.06
See application file for complete search history.

(56) References Cited

U.S. PATENT DOCUMENTS 3,477,610 A * 11/1969 Hansen ..... 220/495.01
3,610,455 A * 10/1971 Greenhalgh et al. ..... 215/12.1

(Continued)

FOREIGN PATENT DOCUMENTS

EP 0194871 A2 9/1986
EP 0389191 A1 9/1990

(Continued)

OTHER PUBLICATIONS

International Search Report issued Sep. 3, 2007 in connection with International Patent Appln. No. PCT/EP2007/055235.

(Continued)

*Primary Examiner* — Gregory Huson
*Assistant Examiner* — Nicolas A Arnett
(74) *Attorney, Agent, or Firm* — Greenberg Traurig, LLP; Eric E. Bleich

(57) ABSTRACT

The invention relates to a container for fluids, in particular liquids, such as beer or water, comprising an outer casing, preferably spheroid and preferably made of a rigid material, a gas and/or liquid tight inner casing of a flexible material located inside the outer casing, a valve part for filling the container with a fluid, and at least one vent via which the inside of the outer casing communicates with the outside at least during filling. One or more spacers are located between the inner casing and the outer casing, providing one or more venting paths at least during filling.

20 Claims, 3 Drawing Sheets

(56) References Cited

U.S. PATENT DOCUMENTS

| | | | | | |
|---|---|---|---|---|---|
| 4,330,066 | A | * | 5/1982 | Berliner | 215/12.1 |
| 4,805,799 | A | * | 2/1989 | Robbins, III | 366/348 |
| 4,874,107 | A | * | 10/1989 | Arnau-Munoz et al. | 220/506 |
| 4,984,713 | A | * | 1/1991 | Chambers et al. | 222/105 |
| 5,135,137 | A | * | 8/1992 | Rudick | 222/1 |
| RE35,540 | E | * | 6/1997 | Davies et al. | 222/402.1 |
| 6,000,549 | A | * | 12/1999 | Perkins | 220/495.03 |
| 6,220,311 | B1 | * | 4/2001 | Litto | 141/67 |
| 6,561,222 | B1 | * | 5/2003 | Gessner et al. | 137/614.18 |
| 6,571,977 | B2 | * | 6/2003 | Goncalez et al. | 220/506 |
| 7,308,991 | B2 | * | 12/2007 | Alberg | 222/105 |
| 7,763,171 | B2 | * | 7/2010 | Beall | 220/495.04 |
| 7,819,286 | B2 | * | 10/2010 | Antheil et al. | 220/495.01 |
| 2001/0032853 | A1 | * | 10/2001 | Kuehn et al. | 220/495.03 |
| 2004/0050863 | A1 | | 3/2004 | Savage et al. | |
| 2007/0023438 | A1 | * | 2/2007 | Kenneth, Jr. | 220/495.04 |

FOREIGN PATENT DOCUMENTS

| | | | |
|---|---|---|---|
| EP | 0626338 | A1 | 11/1994 |
| EP | 0862535 | | 8/1996 |
| EP | 1736421 | A1 | 12/2006 |
| JP | 2003-192031 | A | 7/2003 |
| WO | WO 96/22929 | A1 | 8/1996 |
| WO | WO 00/07902 | A1 | 2/2000 |
| WO | WO 00/78665 | A1 | 12/2000 |

OTHER PUBLICATIONS

Written Opinion issued Sep. 3, 2007 in connection with International Patent Appln. No. PCT/EP2007/055235.

International Preliminary Report on Patentability issued on Jan. 6, 2009 in connection with International Patent Appln. No. PCT/EP2007/055235.

First Office Action for Chinese Patent Application No. 200780027336.5, dated Feb. 25, 2010 (English translation included).

* cited by examiner

CONTAINER FOR FLUIDS, INSERT AND METHOD OF FILLING A CONTAINER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION BY REFERENCE OF MATERIAL SUBMITTED ON A COMPACT DISK

Not Applicable

BACKGROUND OF THE INVENTION (1) Field of the Invention

The invention relates to a container for fluids, in particular liquids, such as beer or water, comprising an outer casing, preferably spheroid and preferably made of a rigid material, a gas and/or liquid tight inner casing of a flexible material located inside the outer casing, a valve part for filling the container with a fluid, and at least one vent via which the inside of the outer casing communicates with the outside at least during filling. The invention also pertains to an insert to be mounted on or in an outer casing to form a container and to a method of filling a container.

(2) Description of Related Art, Including Information Disclosed Under 37 CFR 1.97 and 1.98

EP 862 535 discloses a container for fluids comprising an outer and preferably ellipsoid casing of a flexible, pressure resistant material, a gastight inner casing of flexible material located inside the outer casing, and a filling connection for filling the inner casing.

US 2004/0050863 relates to a collapsible bag for dispensing liquids which includes at least one sheet sealed to define an enclosure and a fitment (spout) attached to the enclosure and out through which liquid in the enclosure is dispensed. An interior surface of the one or more sheets has an integral texture to assist with withdrawal of the liquid from the enclosure when collapsed.

WO 00/78665 relates to a beer container comprising an inner hollow shell (11) of blow moulded PET to hold beer, an outer hollow shell (12) of moulded high density polyethylene enclosing and supporting the inner shell and a spear structure (13) including a dispenser tube (14) extending from a bottom interior region of the inner shell (11) through to a dispensing outlet (16) at the top of the outer shell (12).

EP 389 191 relates to a container for transport, storage and dispensing of beverages, such as beer, comprising an outer container (12) of plastics such as PET, and an inner bag (20) of flexible material, such as layered polyethylene.

BRIEF SUMMARY OF THE INVENTION

It is an object of the present invention to provide an improved container.

To this end, the container according to the invention is characterized by one or more spacers located between the inner casing and the outer casing and providing one or more venting paths at least during filling. It is preferred that the spacers are elongated elements, in particular strips or filaments, or protrusions on the outer wall of the inner casing and/or on the inner wall of the outer casing. It is further preferred that the vent is located in the valve part and that the spacers are attached to or extend to the valve part and/or that the spacers extend or are at least sufficiently long to be able to extend from the vent to at least halfway the outer casing, also when the inner casing is filled with the fluid.

The spacers facilitate significantly faster and more complete filling of the inner casing and/or render the process of filling the inner casing more robust.

The invention further relates to an insert to be mounted on or in an outer casing to form a container as described above, comprising a valve part provided with at least one vent, an inner casing attached to the valve part, and characterized by one or more spacers attached to or integrated with the valve part and/or the outer surface of the inner casing.

It is preferred that the inner casing is folded and is held together by means of a rupture element, in particular a wire, strap or sleeve, preferably made of paper.

The invention also relates to a method of filling a container as described above with a fluid, in particular a liquid, such as beer, comprising the steps of supplying a pressurized gas between the inner and outer casings, supplying a liquid to the inner casing while the valve part is facing downwards, thus displacing the gas along the spacers and through the vent(s).

Within the framework of the present invention the term "spheroid" includes any shape generated by a half-revolution of a circle or a square or rectangle with rounded corners or an ellipse or oval about its major axis or minor axis.

BRIEF DESCRIPTION OF THE SEVERAL VIEWS OF THE DRAWINGS

The invention will now be explained in more detail with reference to the drawings, which show a preferred embodiment of the present invention.

DETAILED DESCRIPTION OF THE INVENTION

The drawings are not necessarily to scale and details, which are not necessary for understanding the present invention, may have been omitted. Further, elements that are at least substantially identical or that perform an at least substantially identical function are denoted by the same numeral.

Figure 1:
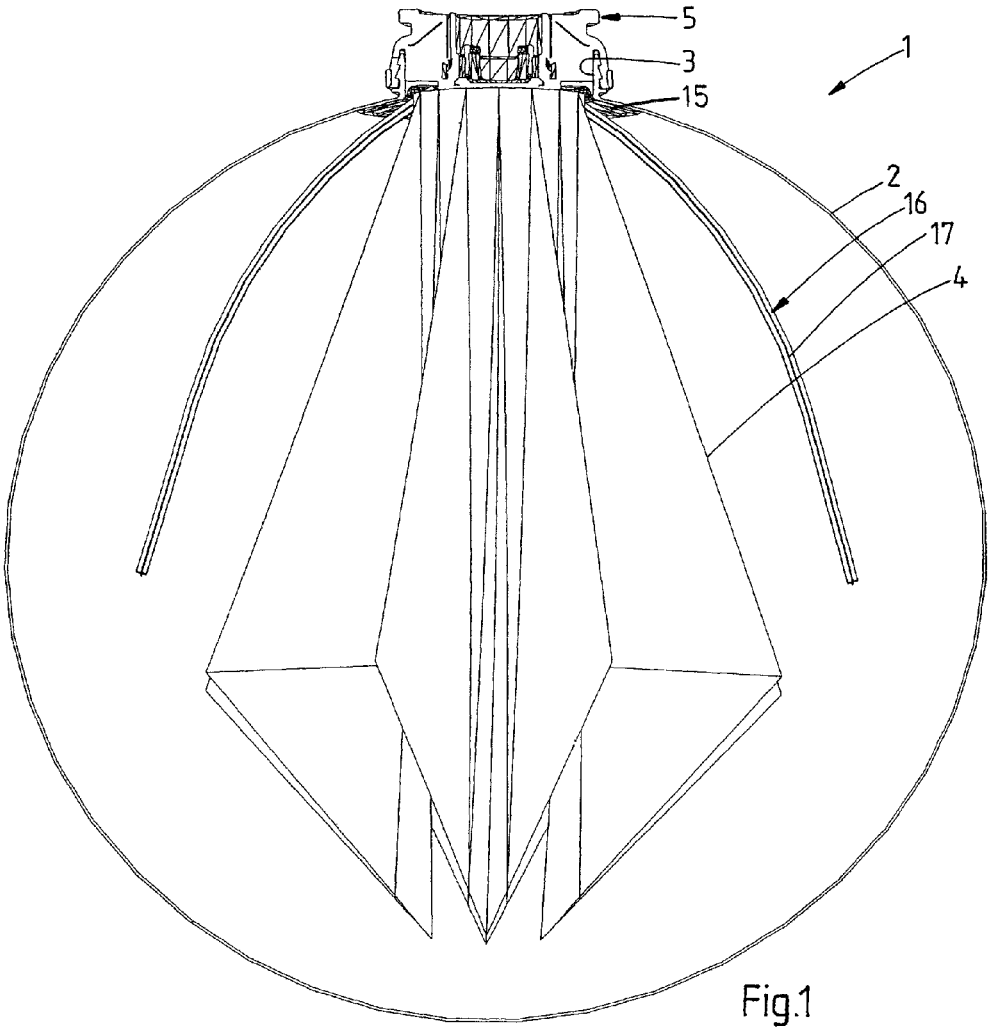
FIG. 1 shows a cross-section through a container according to the present invention.

FIG. 1 shows a container 1 for fluids, in particular liquids, such as beer or soft drinks under pressure, comprising a spherical and pressure resistant outer casing 2 having a central opening 3, a gastight inner casing 4 of a flexible material, i.e. a bag, located inside the outer casing 2, and a valve part 5, located in the central opening 3, for filling the container 1, more specifically the inner casing 3, with a liquid respectively tapping liquid from the container 1.

In this example, the outer casing 2 was made by blow-moulding a polyester preform, such as a PET (polyethylene terephthalate) or PEN (polyethylene naphthalate) preform. The upper rim 7 (FIG. 2) of the preform and (hence) of the opening 3 in the outer casing 2, comprises a collar 8 for holding the preform during blow-moulding in a manner known in itself and, above the collar 8, one or more, in this example two, annular and upwardly tapering ledges 9 for establishing a snap-fit connection with the valve part 5, as will explained in more detail below.

Alternatively, the outer casing may be made of e.g. a relatively thick-walled thermoplastic material or even a metal, such as aluminum. As another example, the outer casing is collapsible and made from a blow-molded thermoplastic e.g. PE or a elastomeric liner provided with a filament wound outer reinforcement and an outer layer of latex obtained by immersing the liner (with filaments) in a latex bath. Yet other suitable casings are described in, for example, EP 0 626 338, which is incorporated herein by reference.

Figure 2:
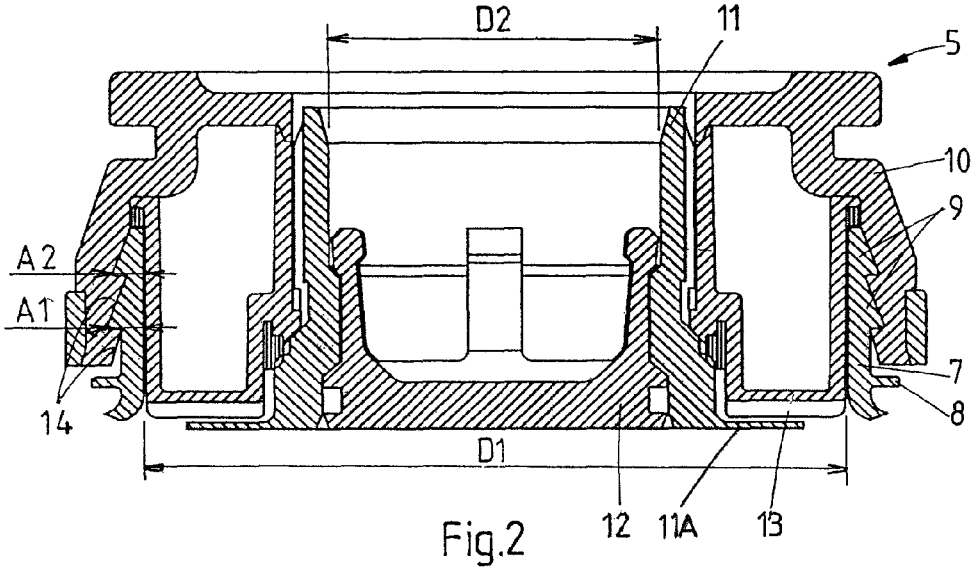
FIG. 2 shows a cross-section of a first embodiment of a valve part for the container in FIG. 1.

As shown in FIG. 2, the valve part 5 comprises an outer jacket 10, made, in this example, of glass fiber reinforced PP, an inner jacket 11 slidably received inside the outer jacket 10, and a closing element 12 which, in turn, is slidably received inside the inner jacket 11. The inner jacket 11 and the closing element are both made of a polyolefin. Another example of a valve part of this type is also disclosed in International patent application WO 00/07902 (see especially page 8, line 12 ff. in conjunction with FIGS. 4A and 4B), which is incorporated herein by reference.

When a probe of a filling unit or a dispense head is pushed into the valve part 5, the inner jacket 11 slides with respect to the outer jacket 10 providing one or more vents for de-aerating the space between the outer and inner casings 2, 4 during filling respectively letting in pressurized gas to expel liquid from the inner casing 4. Further, the closing element 12 slides with respect to the inner jacket 11 providing an opening for letting the liquid in respectively out. As shown in more detail in FIG. 4, the outer jacket 10 comprises, in its bottom surface and preferably on a separate element to facilitate manufacture, a plurality of radially extending channels or, in this case, venting grooves 13.

The inner wall of the outer jacket 10 comprises one or more, in this example two, annular and downwardly tapering counter-ledges 14 (FIG. 2). Thus, the valve part 5 can be snap-fitted substantially irreversibly to the outer casing 2 by holding the outer casing 2 in position, e.g. by means of to semi-circular rings below the collar 8, placing the outer jacket 10, preferably after heating it to 60° C.-80° C., over the upper rim 7, pushing the valve part 5 downwards until the counter-ledges 14 snap-fit over ledges 9 on the rim 7 of the outer casing, and allowing the valve part 5 to cool.

In order to evenly distribute the tension in the upper rim 7 resulting from pressure inside the outer casing 2, the cross-sectional area (A1; FIG. 2) just below the lower ledge 9 is approximately twice the cross-sectional area (A2) just below the upper ledge 9.

The inner casing 3 comprises two, in this example polygonal, flexible sheets of a gas and liquid tight laminate, preferably a laminate comprising a sealing layer (e.g., PE or PP), a barrier layer (e.g. aluminum) and one or more further layers (e.g. PA and/or PET), sealed together along their edges, e.g. by means of welding. As shown in FIG. 1, the inner casing 3 comprises an opening the perimeter of which has been attached, e.g. welded or glued, to a flange 11A (best shown in FIG. 2) on the inner jacket 11 of the valve part 5. The embodiment shown in FIG. 1 further comprises an intermediate, e.g. a foam or an annular polymer film 15, positioned between the inner casing 3 on the one hand and the outer jacket 10 and outer casing 2 on the other. The intermediate fills or bridges any opening between the outer casing 3 and the outer jacket 10 or, in this example, the separate element, thus protecting the inner casing 3, e.g. when elevated temperatures or internal pressure cause(s) the outer jacket 10 or, in this example, the separate element and the outer casing 2 to separate. In this example, the intermediate is attached to the outer wall of the inner casing 3.

The present container is especially suitable for relatively large volumes, i.e. 10 liters or more, preferably 17.5 liters or more. It was found that installing the valve part and the inner casing on the one hand and filling of the container on the other is facilitated considerably if the inner diameter of the central opening (D1; FIG. 2) of the outer casing is larger than 65 mm, preferably larger than 68 mm and preferably smaller than 85 mm, and/or the ratio (D1/D2) of the inner diameter of the central opening (D1; FIG. 2) of the outer casing to the inner diameter of the inner jacket (D2) is in a range from 1.8 to 3.

As the (empty) containers according the present invention typically weigh less than 1.5 kilograms, a container having a maximum total weight of e.g. 23 kilogram still has a capacity of 21.5 kilograms (~litres) of liquid. In comparison, an empty metal keg having a capacity of 21.5 kilograms of liquid would weigh at least 8 kilograms, yielding a total of approximately 30 kilograms.

In accordance with a further aspect of the present invention, one or more spacers, in this example two strips 16 provided with a plurality of longitudinal ridges 17, are attached to the valve part 5 and extend between the inner casing 4 and the outer casing 2. The spacers facilitate significantly faster and more complete filling of the inner casing and/or render the process of filling the inner casing more robust.

To prevent detrimental interaction between the spacers and the inner casing, it is preferred that the spacers are detached from the inner casing, i.e. not welded or glued to or formed in the wall of the inner casing, as such welding, gluing or forming may affect the said wall, e.g. reduce its barrier properties and allow gas or liquid to escape.

Filling of the container according to the present invention with a fluid, in particular a liquid, such as beer, is typically carried out by placing the container upside down, i.e. with the valve part facing downwards, pushing a filling probe into the valve part, thus establishing fluid communication between the (lumen of the) inner casing and a pump for the fluid, and supplying a liquid to the inner casing, preferably at a flow rate of more than 1 liter per second, e.g. 2 liters per second, thus displacing the gas along the spacers and through the vent(s).

If the fluid is a carbonated liquid, a pressurized gas is supplied between the inner and outer casings prior to filling the inner casing in order to prevent the carbon dioxide from escaping and causing the liquid to foam.

Figure 4:
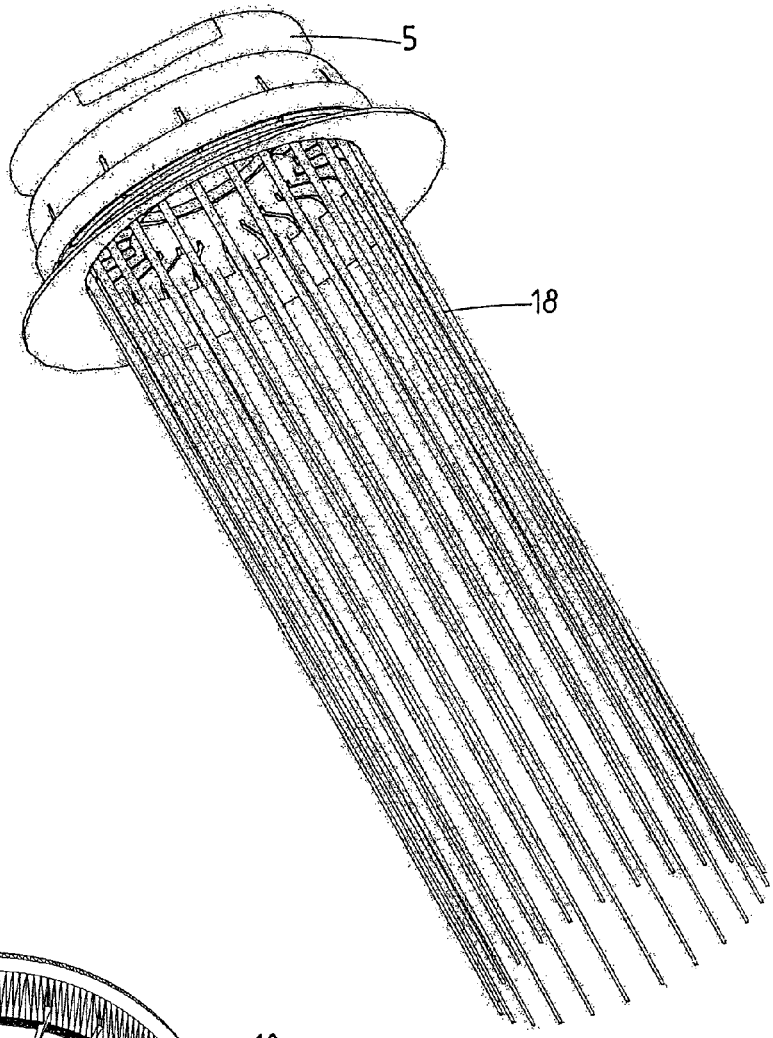
FIG. 4 is a perspective view of a second embodiment of a valve part for the container in FIG. 1.
Figure 3:
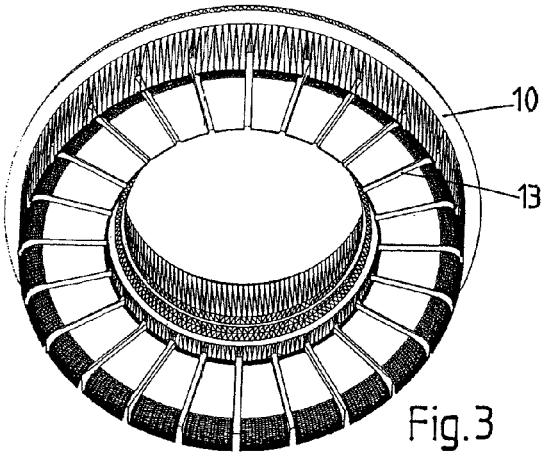
FIG. 3 is a perspective view of a component of the valve part shown in FIG. 2.

FIG. 4 shows an alternative embodiment comprising a plurality of filaments 18 integral with the valve part. The filaments 18 are, on the one hand, sufficiently rigid to remain substantially upright when the valve part is facing downwards and, on the other hand, sufficiently flexible to be pushed, by the inner casing 4 during filling, sideways and against the inner wall of the outer casing 2 thus forming venting paths.

Figure 5:
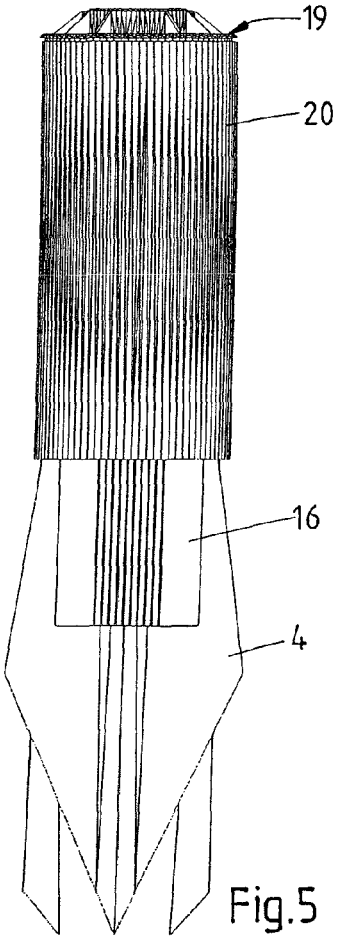
FIGS. 5 and 6 are side views of inserts according to the present invention.
Figure 6:
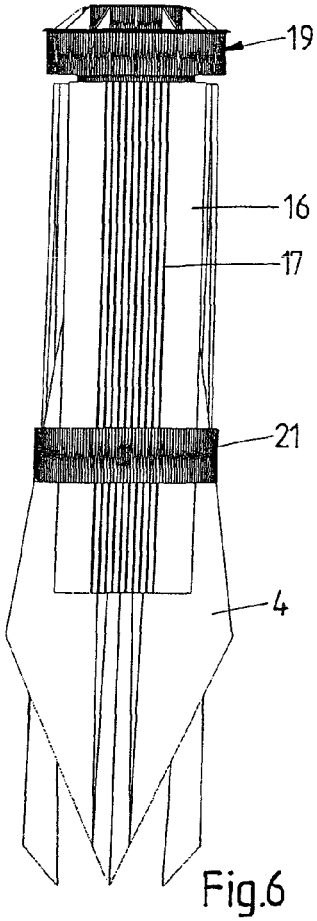

FIGS. 5 and 6 show an insert 19 to be mounted on or in an outer casing to form a container as described above, comprising a folded inner casing 4 and a plurality of strips 16, e.g. two strips, provided with longitudinal venting paths in between ridges 17. The folded inner casing 4 and the strips 16 are held together by means of a rupture element, in this case a paper sleeve 20 (FIG. 5) or a paper strap 21 (FIG. 6). Other suitable rupture elements include e.g. wire and plastic sleeves or straps provided with a weak spot, e.g. perforations or creases.

Further, the bottom of the outer jacket is delimited by a raised edge which extends beyond the circumference of the folded inner casing and which, when the valve part is mounted on the outer casing, extends in the opening of the outer casing, thus preventing the inner casing from becoming jammed between the jacket and outer casing.

The inserts can be readily inserted in and snap fitted to an outer casing, with minimal risk of causing damage to the inner casing. During filling, the expanding inner casing will cause the sleeve or strap to rupture, allowing it to fully deploy.

The invention is not restricted to the above-described embodiments which can be varied in a number of ways within the scope of the claims. For instance, other types of valves, e.g. screwed instead of snap fitted, can be used. Further, the container according to the present invention is in principle also suitable for holding pressurised gasses, for instance medical gasses or industrial gasses, such as LPG or natural gas.

The invention claimed is:

1. A container for fluids, comprising an outer casing, a gas and/or liquid tight inner casing of a flexible material located inside the outer casing, a valve part for filling the container with a fluid, and at least one vent via which the inside of the outer casing communicates with the outside at least during filling, characterized by one or more spacers located between the inner casing and the outer casing and providing one or more venting paths at least during filling.

2. The container according to claim 1, wherein the spacers are elongated elements on the outer wall of the inner casing and/or on the inner wall of the outer casing.

3. The container according to claim 1 or 2, wherein the vent is located in the valve part and the spacers are attached to or extend to the valve part.

4. The container according to claim 1, wherein the spacers extend or are at least sufficiently long to be able to extend from the vent to at least half the height of the outer casing.

5. The container according to claim 1, wherein the spacers are detached from the inner casing.

6. The container according to claim 1, wherein the outer casing has been made by blow-moulding a polymer preform.

7. The container according to claim 6, wherein the outer casing has a central opening, wherein the valve part has an opening for filling the inner casing with the fluid and is mounted in the central opening, and wherein the inner diameter of the central opening is larger than 65 mm and/or the ratio of the inner diameter of the central opening of the outer casing to the inner diameter of the opening for filling is in a range from 8:1 to 3:1.

8. The container according to claim 7, wherein the inner diameter of the central opening is larger than 68 mm.

9. The container according to claim 1, wherein the valve part and/or the outer casing comprise one or more elements for establishing an irreversible snap connection with a counterpart on the outer casing or the valve part, respectively.

10. The container according to claim 9, wherein the outer casing comprises two or more annular and upwardly tapering ledges and wherein the cross-sectional area just below the lowest ledge is larger than the cross-sectional area just below the ledge above it.

11. The container according to claim 1, comprising an intermediate positioned between the inner casing on the one hand and the valve part and the outer casing on the other.

12. The container according to claim 11, wherein the intermediate comprises an annular film.

13. An insert to be mounted on or in an outer casing to form a container according to claim 1, comprising a valve part provided with at least one vent, an inner casing attached to the valve part, characterized by one or more spacers attached to or integrated with the valve part and/or the outer surface of the inner casing.

14. The insert according to claim 13, wherein the spacers are elongated elements on the outer wall of the inner casing.

15. The insert according to claim 13 or 14, wherein the inner casing is folded and is held together by means of a rupture element.

16. The insert according to claim 15, wherein the bottom of the valve part is delimited by a raised edge which extends beyond the circumference of the folded inner casing.

17. A method of filling a container according to claim 1 with a fluid, comprising the steps of supplying a pressurized gas between the inner and outer casings, supplying a liquid to the inner casing while the valve part is facing downwards, thus displacing the gas along the spacers and through the at least one vent.

18. The method according to claim 17, wherein the liquid is supplied at a flow rate of more than 1 liter per second.

19. The container according to claim 1, wherein the outer casing is spheroid and/or made of a rigid material.

20. The container according to claim 1, wherein the fluids include a liquid selected from the group consisting of beer and water.

* * * * *